United States Patent [19]

Brocklebank et al.

[11] Patent Number: 4,557,896

[45] Date of Patent: Dec. 10, 1985

[54] TREATMENT OF AQUEOUS SYSTEMS

[75] Inventors: Philip Brocklebank, Warrington; John J. Bennison, Runcorn, both of England

[73] Assignee: Dearborn Chemicals Limited, Widnes, England

[21] Appl. No.: 271,872

[22] Filed: Jun. 9, 1981

[30] Foreign Application Priority Data

Sep. 25, 1980 [GB] United Kingdom ..... 8030967

[51] Int. Cl.[4] ..... C23F 11/00; C23F 11/08; C23F 11/10

[52] U.S. Cl. ..... 422/14; 422/15; 422/17

[58] Field of Search ..... 422/15, 17, 14; 252/389 A, 389 R, 387

[56] References Cited

U.S. PATENT DOCUMENTS

| | | | |
|---|---|---|---|
| Re. 28,553 | 9/1975 | Freyhold | 422/15 |
| 3,925,245 | 12/1975 | Harris et al. | 252/389 A |
| 4,057,511 | 11/1977 | Bohnsack | 252/309 |
| 4,206,075 | 6/1980 | Boffardi | 422/15 |
| 4,209,398 | 6/1980 | Ii | 210/609 |
| 4,209,487 | 6/1980 | Hogue et al. | 422/15 |
| 4,277,359 | 4/1981 | Lipinski | 252/181 |
| 4,317,744 | 3/1982 | Levi | 422/17 |

FOREIGN PATENT DOCUMENTS 2032411 5/1980 United Kingdom .

OTHER PUBLICATIONS

Held, Kuhlwasser, Vulkan-Verlag, p. 218, (Essen, 1970).

Marshall, "An Investigation into the Mechanism of Inhibition of a Synergistic Dionodic Corrosion Inhibitor", *Corrosion-NACE*, vol. 37, No. 4, pp. 214–222, (Apr. 1981).

*Primary Examiner*—William F. Smith

*Attorney, Agent, or Firm*—Edward J. Cabic

[57] ABSTRACT

Composition and method for inhibiting corrosion in aqueous systems using synergistic combination of an inorganic nitrite and a phosphonate, e.g., 10–20 ppm sodium nitrite plus 0.5–5 ppm hydroxyethylidene diphosphonic acid.

8 Claims, No Drawings

TREATMENT OF AQUEOUS SYSTEMS

The present invention relates to the treatment of aqueous systems and, more particularly, to reducing or eliminating corrosion in aqueous systems.

Many different types of material have been employed to prevent corrosion in aqueous systems. These include inorganic salts such as nitrites and chromates, inorganic mono- and polyphosphates and certain water-soluble polymers including naturally occurring materials such as lignins and starches as well as synthetic materials such as polyacrylates.

Particular problems arise in cooling systems which are subject to intermittent operation of periodic shut-down. This is because the majority of corrosion inhibitors and the like only function effectively when the cooling system is in motion. Indeed, the only materials which have so far proved to be at all effective for systems involving periodic shut-down are the nitrites and, to a less extent, the chromates. Unfortunately, however, while nitrites are effective they have to be used in quite high concentrations; amounts as much as 1000 ppm are not uncommon. Such amounts present disposal problems because these inorganic nitrites are quite toxic. Thus the maximum nitrogen content permitted by the World Health Organization in drinking water is equivalent to only 45 mg/l of sodium nitrite. However, such quantities of nitrite are ineffective for use as a corrosion inhibitor in cooling systems subject to intermittent operation.

It has now been found, according to the present invention, that it is possible to obtain effective corrosion inhibition if a "non-toxic" amount of inorganic nitrite, that is to say, less than 45 ppm is used in combination wth a particular class of phosphonate. It has surprisingly been found that a synergistic effect is produced when an inorganic nitrite is used in combination with a phosphonate having the general formula:

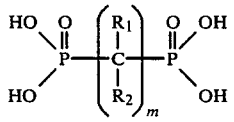

(I)

wherein m is an integer from 1 to 10, $R_1$ is hydrogen or alkyl of 1 to 4 carbon atoms and $R_2$ is hydroxyl, hydrogen or alkyl of 1 to 4 carbon atoms.

Accordingly, the present invention provides a method of controlling inhibition in aqueous systems which comprises adding to the aqueous system at least one water soluble inorganic nitrite and at least one phosphonate of formula (I) as defined above.

The preferred phosphonate is hydroxyethylidene diphosphonic acid, i.e., $R_1$ is methyl, $R_2$ is hydroxyl and m is 1 (HEDPA).

While it is possible to add the materials separately it will generally be more convenient to incorporate them together in the form of a composition. Accordingly, the present invention also provides a composition suitable for addition to water to reduce or prevent corrosion which comprises at least one water soluble inorganic nitrite and at least one phosphonate of formula (I) as defined above.

Typically, the water-soluble nitrite is sodium nitrite but other alkali metal nitrites and also calcium nitrite are also suitable.

As indicated above, by incorporating the specified phosphonate with the inorganic nitrite it is possible to obtain effective corrosion inhibition even though the concentration of nitrite is less than 45 ppm. Indeed, amounts as little as 10 ppm have been found to be effective. Preferably, the nitrite is present in the system in an amount from 10 to 35 ppm and especially 10 to 20 ppm. The amount of phosphonate used will generally be less than that of the nitrite in order to keep costs down and, in general, amounts from 0.1 to 20 ppm are suitable, amounts from 0.5 to 5 ppm being preferred thereby keeping down the phosphorus content in the water so as to reduce disposal problems.

Phosphonates other than those of formula (I), in general, do not provide advantageous results and should, therefore, generally not be used in the system.

It has further been found that the presence of a water-soluble organic polymer in the system can further inhibit corrosion and, indeed, in certain cases an additional synergistic effect is found.

In general, the polymers suitable for use in the present invention are vinyl addition products possessing recurring units of the general formula:

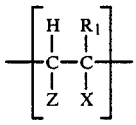

wherein $R_1$ represents hydrogen or alkyl of 1 to 4 carbon atoms, X represents COOH, and Z represents hydrogen or COOH; and X and Z together may represent —CO—O—CO—. The preferred polymers are those of methacrylic acid, i.e., where $R_1$ is methyl and Z is hydrogen and acrylic acid, i.e., where $R_1$ and Z are both hydrogen. In general, the molecular weight of the polymers is from 500 to 100,000 and the preferred polymethacrylic acid has a molecular weight of about 5000 and the preferred polyacrylic acid a molecular weight of about 1000. It will, of course, be appreciated that the polymers used may be copolymers containing recurring units derived from other vinyl monomers.

Not only does the presence of polymer further reduce corrosion but since the polymers are, in general, less expensive than the phosphonates used, by incorporating polymer and, in particular, by replacing some of the phosphonate by polymer it is possible further to reduce the cost of the additives. Of course, the polymer can be added to the system separately but it will, in general, be incorporated in a composition with the nitrite and phosphonate.

Although the formulae of the phosphonate and polymer have been given in terms of the free acid it is to be understood that these materials can be used in the form of an inorganic or organic salt, in particular an alkali metal salt such as sodium or potassium, ammonium or a lower amine salt as well as zinc or other salts. In general, however, the use of alkali metal salts is preferred.

Typically, the polymer is used in an amount from 0.5 to 50 ppm, the preferred amount being from 2 to 10 ppm.

It will be appreciated that other low toxic materials conventionally used in water treatment can be added to the system and/or the composition including silicates, inorganic phosphates and polyphosphates, lignin derivatives, and the like.

The compositions of the present invention will normally be in the form of an aqueous solution but other possible forms include powders and briquettes.

The following examples further illustrate the present invention. In these examples two different types of tests were employed, namely a circulatory test and a test to simulate intermittent flow operations.

In the circulatory test a laboratory test apparatus was used in which water is circulated by means of a pump from a reservoir maintained at a temperature of 40° C. with a heater and thermostat. The water passes through a glass tube assembly holding the metal test specimens and then is returned to the reservoir entraining air as it does so in order to keep the water saturated with oxygen as it would be in a typical open recirculating cooling system.

Water lost by evaporation is replaced from an elevated tank through a float control to maintain a constant volume in the system.

In each test, treatment is applied at three times normal dose for 24 hours in order to passivate the metals; then the water is diluted to the normal dose for the remainder of the test. Each test is for a minimum of 3 days, the test specimens being cleaned before and after each run to find the weight loss which is then calculated to show the average corrosion rate in mils (0.025) per year.

The water used in the tests was Widnes (England) mains water. The water had a total hardness of 140 mg/l, M.alkalinity of 100 mg/l, and Langelier Index of minus 0.5 which concentrates two times during the test due to evaporation.

The results obtained using HEDPA as the phosphonate and poly methacrylic acid of molecular weight 5000 as polymer and sodium nitrite are given in the following Table I:

(Note, in the tables, 1 mg/liter equals 1 ppm.)

TABLE 1

| Example No | Additives mg/liter | | | Corrosion rate, mils/year | | |
|---|---|---|---|---|---|---|
| | Nitrite | Phosphonate | Polymer | Steel | Copper | Aluminium |
| 1 | — | — | — | 26.6 | 0.2 | 2.9 |
| 2 | 20 | — | — | 12.7 | 0.1 | 1.4 |
| 3 | 15 | — | — | 19.5 | 0.1 | 1.4 |
| 4 | 10 | — | — | 31.9 | 0.2 | 2.6 |
| 5 | — | 20 | — | 13.4 | 0.1 | 1.7 |
| 6 | — | — | 20 | 18.3 | 0.1 | 0.9 |
| 7 | — | 10 | 10 | 23.3 | 0.1 | 1.0 |
| 8 | 15 | 5 | — | 4.6 | 0.4 | 2.6 |
| 9 | 15 | — | 5 | 9.7 | 0.1 | 2.7 |
| 10 | 15 | 2.5 | 2.5 | 3.9 | 0.1 | 0.8 |

Examples 1 to 7 show that nitrite alone at 20 to 15 mg/l showed some slight corrosion inhibition to steel while at 10 mg/l was giving increased corrosion. The phosphonate and polymer at 20 mg/l also showed slight inhibition when used alone but almost none when used together at 10 mg/l. Examples 8 to 10 show that combining 15 mg/l nitrite with 5 mg/l of phosphonate gave a marked improvement while with 5 mg/l polymer there was also some improvement. However, there was a greater improvement when using 15 mg/l nitrite with 2.5 mg/l each of polymer and phosphonate.

Further results were obtained as shown in the following table for corrosion of mild steel where the major effect is normally observed.

| Additives Mg/Liter | | | Corrosion Rate Mild Steel |
|---|---|---|---|
| Nitrite | HEDPA | POLYMER[1] | Units per year |
| — | — | — | 26.6 |
| 20 | — | — | 12.7 |
| — | 20 | — | 13.4 |
| — | — | 20 | 18.3 |
| 15 | — | — | 19.5 |
| 15 | 5 | — | 4.6 |
| 15 | — | 5 | 9.7 |
| 15 | 2.5 | 2.5 | 3.9 |
| — | 5 | — | 5.0 |
| — | — | 5 | 28.0 |
| — | 2.5 | 2.5 | 27.4 |

[1]Poly methacrylic acid.

In the test made under intermittent flow conditions the procedure is the same as that in the circulatory test except that the apparatus is connected to the main electricity supply via a time-switch. This is set to allow the rig to operate for 12 hours during the day and is then shut off for 12 hours each night. The only other difference was that a water temperature of 50° C. was used when the rig was running. This would drop to room temperature after shut-off.

The following symbols are used in the following Tables giving the results obtained:

HEDPA = Hydroxy ethylidene diphosphonic acid
PMA = Sodium polymethacrylate
PAA = Sodium polyacrylate
PBTA = 2-Phosphono-butane-tricarboxylic acid
DTPPA = Diethylene triamine pentamethylenephosphonic acid

| | Additives Mg/liter | | | Corrosion rate Mild Steel |
|---|---|---|---|---|
| | Nitrite | Phosphonate | Polymer | mpy |
| 1 | — | — | — | 32.0 |
| 2 | 30 | — | — | 42.0 |
| 3 | — | 30 HEDPA | — | 17.0 |
| 4 | — | — | 30 PMA | 25.5 |
| 5 | 25 | 5 HEDPA | — | 6.0 |
| 6 | 25 | — | 5 PMA | 38.0 |
| 7 | 25 | 2.5 HEDPA | 2.5 PMA | 15.5 |
| 8 | — | — | 30 PAA | 18.5 |
| 9 | 25 | — | 5 PAA | 19.5 |
| 10 | 25 | 2.5 HEDPA | 2.5 PAA | 15.5 |
| 11 | — | 30 PBTA | — | 7.0 |
| 12 | 25 | 5 PBTA | — | 21.0 |
| 13 | 25 | 2.5 PBTA | 2.5 PAA | 22.5 |
| 14 | — | 30 DTPPA | — | 9.5 |
| 15 | 25 | 5 DTPPA | — | 30.5 |
| 16 | 25 | 2.5 DTPPA | 2.5 PAA | 14.5 |

These results show that a blend of nitrite and HEDPA (compare runs 2, 3 and 5) gives better inhibition than either alone at the same dose rate. Polymethacrylate plus nitrite has little effect (run 6), but the triple blend of nitrite, HEDPA and PMA (run 7) is much improved. Again, the use of polymethacrylate gives a comparable result to polyacrylate when used with nitrite and HEDPA (compare runs 8 to 10). Runs 11 to 16, by comparison, show that other types of phosphonate provide little improvement over the use of nitrite alone.

We claim:

1. Method of inhibiting corrosion in aqueous cooling systems comprising adding thereto as the sole corrosion inhibiting ingredient a mixture consisting of a water soluble inorganic nitrite and a phosphonate of the formula

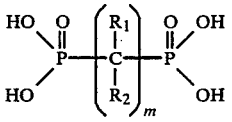

(I)

wherein m is an integer from 1 to 10, $R_1$ is hydrogen or alkyl of 1 to 4 carbon atoms and $R_2$ is hydroxyl, hydrogen or alkyl of 1 to 4 carbon atoms, said nitrite being present in an amount of 10–35 ppm and said phosphonate being present in an amount of 0.1 to 20 ppm.

2. Method according to claim 1 wherein the nitrite is added at 10–20 ppm and the phosphonate at 0.5–5 ppm.

3. Method according to claim 1 in which the nitrite is sodium nitrite.

4. Method according to claim 1 in which the phosphonate is hydroxyethylidene diphosphonic acid.

5. Method of inhibiting corrosion in aqueous cooling systems comprising adding thereto as the sole corrosion inhibiting ingredient a mixture consisting of a water soluble inorganic nitrite, a phosphonate of the formula

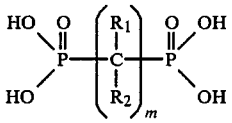

(I)

wherein m is an integer from 1 to 10, $R_1$ is hydrogen or alkyl of 1 to 4 carbon atoms and $R_2$ is hydroxyl, hydrogen or alkyl of 1 to 4 carbon atoms, and a polymer having a molecular weight of 500–100,000 and possessing recurring units of the general formula:

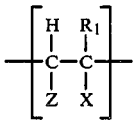

wherein $R_1$ represents hydrogen or alkyl of 1 to 4 carbon atoms, X represents COOH, and Z represents hydrogen or COOH; or X and Z together represent —CO—O—CO—, said nitrite being present in an amount of 10–35 ppm, said phosphonate being present in an amount of 0.1 to 20 ppm, and said polymer being present in an amount of 0.5 to 50 ppm.

6. Method according to claim 5 in which the polymer is polymethacrylic acid having a molecular weight of about 5000.

7. Method according to claim 5 in which the polymer is polyacrylic acid having a molecular weight of about 1000.

8. Method according to claim 3 in which 2–10 ppm of the polymer is added.

* * * * *